United States Patent [19]

Raymond

[11] Patent Number: 4,658,843

[45] Date of Patent: Apr. 21, 1987

[54] FLEXED FAN UMBRELLA APPARATUS

[76] Inventor: Robert J. Raymond, 379 W. Park Ave., Apt. A, El Cajon, Calif. 92020

[21] Appl. No.: 788,060

[22] Filed: Oct. 16, 1985

[51] Int. Cl.[4] ..... A45B 21/00; A45B 11/00; A63H 27/08

[52] U.S. Cl. ..... 135/19.5; 135/20 A; 244/153 R

[58] Field of Search ..... 135/19.5, 20 R, 20 A, 135/20 B, 30, 74, 98, 104, 117, 900, 901, DIG. 1; 244/153 R

[56] References Cited

U.S. PATENT DOCUMENTS

| | | | |
|---|---|---|---|
| 494,333 | 3/1893 | Hill | 135/98 |
| 1,126,293 | 1/1915 | Ryder | 135/20 A |
| 1,265,704 | 5/1918 | Howard et al. | 135/31 |
| 1,328,901 | 1/1920 | Ryder | 135/20 A |
| 1,356,264 | 10/1920 | Cannon | 135/20 R |
| 1,946,137 | 2/1934 | Frost | 135/DIG. 1 X |
| 2,442,417 | 6/1948 | Lang | 244/153 R |
| 2,605,778 | 8/1952 | Clapper | 135/20 |
| 2,707,476 | 5/1955 | Clemens | 135/20 |
| 2,948,289 | 8/1960 | Owczarek | 135/20 |
| 3,276,730 | 10/1966 | Cleveland | 244/153 R |
| 3,285,260 | 11/1966 | Rowe | 135/98 X |
| 3,467,114 | 9/1969 | McSherry | 135/20 R |
| 3,622,201 | 11/1971 | Radig | 297/217 |
| 3,706,160 | 12/1972 | Diebert | 135/20 R X |
| 3,749,338 | 7/1973 | Kinsey | 244/153 R |
| 3,825,024 | 7/1974 | Cohen | 135/20 R |
| 3,844,301 | 10/1974 | Harrell | 135/20 R |
| 4,086,931 | 5/1978 | Hall | 135/20 |
| 4,312,371 | 1/1982 | Koon | 135/19.5 |
| 4,332,266 | 6/1982 | Wageley | 135/5 R |
| 4,347,862 | 9/1982 | Secon | 135/20 |

FOREIGN PATENT DOCUMENTS

| | | | |
|---|---|---|---|
| 12836 | of 1885 | United Kingdom | 244/153 R |
| 159743 | 3/1921 | United Kingdom | 135/20 R |

*Primary Examiner*—Robert A. Hafer
*Assistant Examiner*—D. Neal Muir
*Attorney, Agent, or Firm*—H. Gordon Shields

[57] ABSTRACT

Umbrella apparatus includes a plurality of flexible support elements extending outwardly from a common location on a base cross piece. Flexible material is secured to the base cross piece and to the flexible elements. The umbrella apparatus is foldable when tension is removed between the flexible elements and the base cross piece.

14 Claims, 15 Drawing Figures

FLEXED FAN UMBRELLA APPARATUS

BACKGROUND OF THE INVENTION

1. Field of the Invention

This invention relates to umbrellas and, more particularly, to umbrellas in which a plurality of flexible elements is secured together at a base element, and covering material is secured to both the base elements and to the flexible elements.

2. Description of the Prior Art

U.S. Pat. No. 494,333 discloses a generally fan shaped umbrella. The umbrella includes a vertical support attached to a base element. Support lines extend from the outer or open end of the umbrella to the vertical support rod so that the umbrella panels are secured to the vertical support element at two locations, at the base of the umbrella and at the outer ends of the umbrella panels.

U.S. Pat. No. 1,126,293 discloses another type of umbrella in which a handle element is secured to one end of a plurality of umbrella panels. The umbrella panels fan out, and in the open position of the panels, additional reinforcing elements extend from the handle to the panels. Several different configurations of the umbrella are illustrated.

U.S. Pat. No. 1,265,704 discloses another type of umbrella in which a plurality of panels are secured to a central handle. The panels, as in conventional umbrellas, are secured to the handle in the center of the panels, by reinforcing ribs or elements, and additional elements extend from the handle outwardly to the reinforcing ribs of the umbrella panels. The support elements move upwardly to lock the umbrella in the open position, and move downwardly to close the umbrella. This patent typifies the opening and closing of umbrellas in contemporary usage.

U.S. Pat. No. 1,328,901 discloses another type of umbrella with an offset panel structure. The '778 patent utilizes an offset structure with the vertical arms spaced apart from the vertical portion of the umbrella, and a connecting rod or link extends between the umbrella and the vertical support rod. The connecting link is adjustable for adjusting the orientation of the umbrella with respect to the vertical member. The vertical member comprises a handle. The umbrella element itself includes a variety of panels with reinforcing structural ribs secured to the panels, and support arms extending from the reinforcing arms to a central shaft, which is virtually the same as the umbrella arrangement of the '704 patent.

U.S. Pat. No. 2,605,778 discloses another type of umbrella apparatus with a central umbrella element and an offset handle and a link between the central umbrella apparatus and the handle. The connecting link is adjustable so that the umbrella may be oriented in different ways with respect to the handle.

U.S. Pat. No. 2,707,476 discloses another type of offset umbrella apparatus in which the supporting structure for the umbrella panels extend radially outwardly at various angles with respect to each other and at various distances. That is, the supporting elements are different lengths and are disposed at differing angles with respect to each other to provide an offset structure from a central handle or vertical support element. As with the other umbrella structures in the above-discussed patents, support elements extend outwardly from the umbrella handle to the umbrella rods to which the panels are secured to provide the necessary structural strength to support the umbrella panels.

U.S. Pat. No. 2,948,289 discloses another type of offset umbrella structure. In the '289 patent, the umbrella support structure is essentially the same as discussed above, with support elements or ribs extending from a handle outwardly to the support elements for the umbrella panels.

U.S. Pat. No. 3,622,201 discloses a type of shelter or blind that is offset from a primary vertical support element. The apparatus is designed for hunting, and integral seats are provided as part of the supporting structure. The apparatus utilizes umbrella type supporting structure, in that a covered frame is used to support exterior covering panels, and the support structure is in turn secured to a primary support element to which a seat is secured.

U.S. Pat. No. 4,086,931 discloses another type of offset umbrella structure designed primarily for stadium use. The umbrella protion extends over a spectator and includes side curtains which extend downwardly from a top support structure. There are two sets of structural elements which connect the umbrella to a vertical support rod, including a sliding portion which moves on a vertical support rod, and ribs which extend outwardly from the sliding portion to the upper support elements to which the panels of the apparatus are secured.

U.S. Pat. No. 4,312,371 discloses a hand-held umbrella with a handle having an off-center portion for convenience of the user. Several different embodiments are illustrated, including embodiments in which a pole or a handle is used and is offset from the center of the umbrella. The umbrella may also be adjusted relative to the support or handle for convenience. The umbrella is supported at its outer periphery by a ring or closed loop. For storage purposes, the ring is sufficiently flexible to be folded on itself to form smaller rings. A handle for support extends between the ring and the center of the umbrella. It is the handle extending inwardly from the ring which provides the umbrella with its concave inner configuration. Additional structural elements are apparently not needed.

U.S. Pat. No. 4,332,266 discloses another type of umbrella which is also usable as a blind or a shelter. The umbrella apparatus has a general fan-shaped configuration, with a plurality of ribs supporting the apparatus. There is a main, outer supporting rib and a plurality of ribs on either side of the main rib for support purposes.

U.S. Pat. No. 4,347,862 discloses a beach or lawn umbrella which uses bent struts to hold the umbrella in an up or open position. A vertical mast is also used, and the bent struts are secured to the vertical mast. By moving the struts relative to the vertical mast, the umbrella can be tilted or moved to provide different orientations.

SUMMARY OF THE INVENTION

The invention described and claimed herein comprises a generally shell-shaped umbrella having a curved configuration provided by a plurality of flexible support elements. The flexible support elements extend outwardly from a generally common location along a base member.

Among the objects of the present invention are the following:

To provide new and useful umbrella apparatus;

To provide new and useful folding umbrella apparatus;

To provide new and useful umbrella apparatus having a plurality of structural support elements;

To provide new and useful umbrella apparatus having a base member to which a plurality of support elements are secured;

To provide new and useful umbrella apparatus having a folding base element; and

To provide new and useful umbrella apparatus having a plurality of support elements secured to a base element at a single location.

DESCRIPTION OF THE PREFERRED EMBODIMENT

Figure 1:
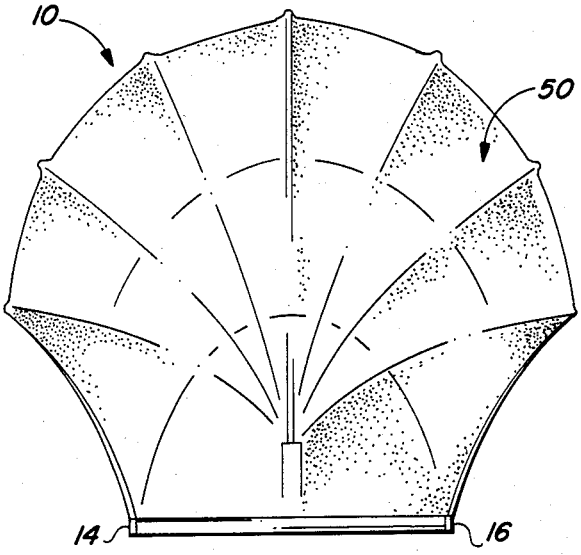
FIG. 1 is a back view of the apparatus of the present invention in its open configuration.
Figure 2:
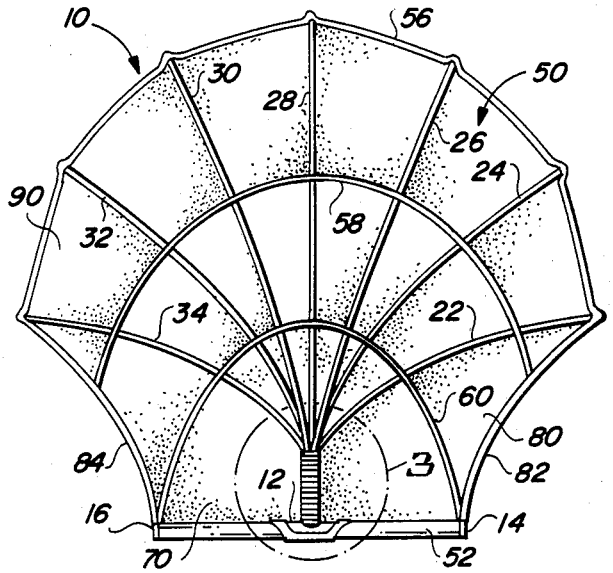
FIG. 2 is a front view of the apparatus of the present invention in its open configuration.

FIG. 1 is a back view of umbrella apparatus 10 of the present invention. FIG. 2 is a front view of the umbrella apparatus 10. The umbrella apparatus 10 comprises a frame which includes a base support element 12 and a support rod cluster 20, comprising a plurality of support rods or elements 22, 24, 26, 28, 30, 32, and 34, extending outwardly from about the center of the base support element 12. Flexible material 50 is secured to both the base support element 12 and to the support rods 22 . . . 34 to comprise the umbrella apparatus 10. As is best shown in FIGS. 1 and 2, the umbrella apparatus is in the general shape of a scallop or seashell, with a generally convex back or rear portion and a generally concave front portion.

Figure 3:
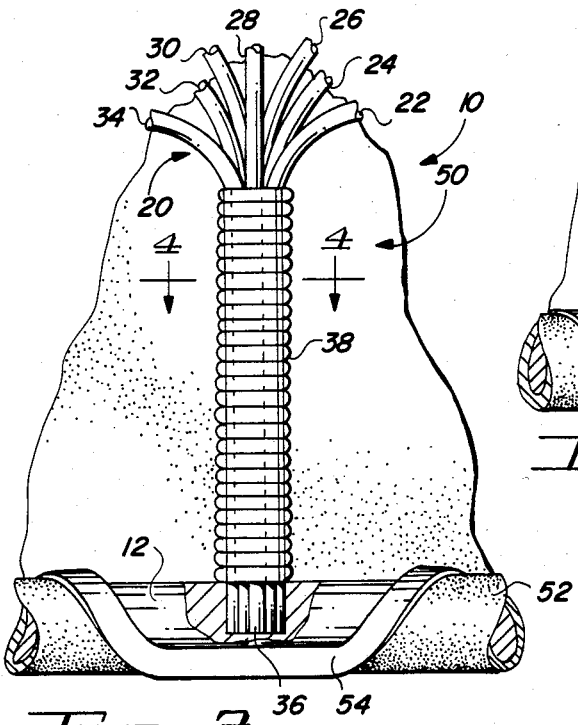
FIG. 3 is an enlarged view of a portion of the apparatus of FIG. 2, taken generally from circle 3 of FIG. 2.
Figure 5:
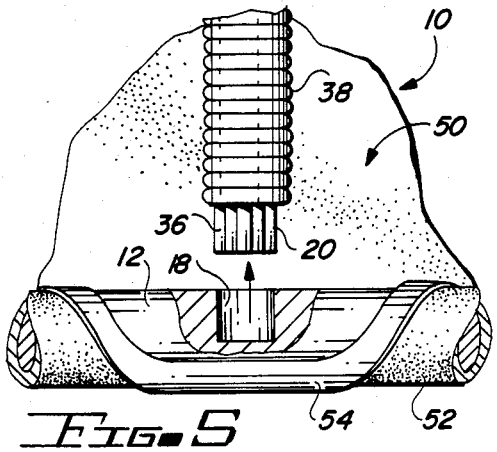
FIG. 5 is an enlarged view in partial section of a portion of the apparatus of the present invention.
Figure 4:
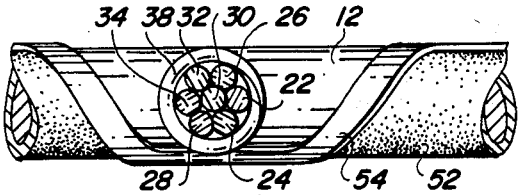
FIG. 4 is a view in partial section taken generally along line 4—4 of FIG. 3.

FIG. 3 is an enlarged view of a portion of the umbrella apparatus 10 taken generally from circle 3 of FIG. 2, illustrating the securing of the support rods or elements 22 . . . 34 to the base support element 12. FIG. 4 is a view in partial section taken generally along line 4—4 of FIG. 3, showing how the support rod elements 22 . . . 34 are clustered together and inserted into the base element 12. FIG. 5 is an enlarged view illustrating the removal of the support rods from the base element 12. For the following discussion, reference will primarily be made to FIGS. 1, 2, 3, 4, and 5.

The support rods 22 . . . 34 are clustered together adjacent to the base support element 12 by a wrap or sleeve 38. The support rod cluster 20 includes a relatively short lower end portion 36 below the bottom of the sleeve 38. The lower end 36 extends into a hole or socket 18 in the base element 12. Above the sleeve 38, and remote from the lower end 36, the support rods 22 . . . 34 fan or extend generally outwardly or diverge from each other, and curve to provide the flexed fan concave-convex configuration of the umbrella apparatus 10. The rods 22 . . . 34 are preferably made of fiberglass material, or similar material which includes the characteristics of strength and flexibility so that they may curve as required.

The material 50 is secured to both the base element 12 and to the rods 22 . . . 34. The material 50 is preferably a one-piece element with the appropriate configuration to outline the general seashell shape. Obviously, if some other design than a "seashell" is desired, such may be easily provided.

The base support element 12 includes a pair of ends 14 and 16, and the socket 18 is disposed midway between the ends 14 and 16. The material 50 includes a base tube 52 which extends over the base support element. Within the base tube 52 there is a cutout portion 54 adjacent to the socket or hole 18. This is best shown in FIGS. 3, 4, and 5.

Reinforcing material 56 is disposed at the outer edge of the umbrella material 50 to provide the required structural reinforcement for the material 50. The reinforcement 56 also includes sockets which receive the outer ends of the support rods or elements 22 . . . 34.

In addition to the outer edge reinforcement 56, there are two other reinforcement bands extending arcuately from side to side on the material 50. The bands include a center arcuate reinforcement band 58 and a lower reinforcement band 60. The lower reinforcement band 60 extends arcuately between the outer edges of the base tube 52, adjacent to the ends 14 and 16 of the base element 12. The center reinforcement 58 extends arcuately, generally parallel to and between the outer edge reinforcement 56 and the lower reinforcement 60. Both the reinforcement bands 58 and 60 include holes or apertures through which the support rods or elements 22 . . . 34 extend. Thus, the support rods or elements 22 . . . 34 are integrally secured to the material 50 through the various holes or apertures in the reinforcement strips 58 and 60 and in the sockets in the outer or edge reinforcement strip 56.

As best shown in FIG. 2, the reinforcement portions 58 and 60 generally divide the umbrella material 50 into three portions, a lower portion 70, a middle portion 80, and an upper portion 90. The lower portion 70 includes the base tube 52 through which the base element 12 extends. The outer edge reinforcement 56 and the lower reinforcement band 60 intersect at the base tube 52, adjacent to the ends 14 and 16 of the base support element 12.

The middle portion 80 extends between the lower portion 70 and the outer portion 90, and is generally arcuately extending. The outer portion 90, between the outer edge reinforcement 56 and the center reinforcement 58, is also generally arcuately shaped.

To insure the concave inner configuration of the umbrella apparatus 10, the lower portion 70 and the middle portion 80 are relatively taut. This is particularly true with respect to the lower portion 70 and a pair of outer edges 82 and 84 of the center or middle portion 80. The tautness of the material 50 causes the rods 22 . . . 34 to bow, and the material 50, following the bowing of the rods 22 . . . 34, assumes the concave-convex shell configuration.

Figure 6:
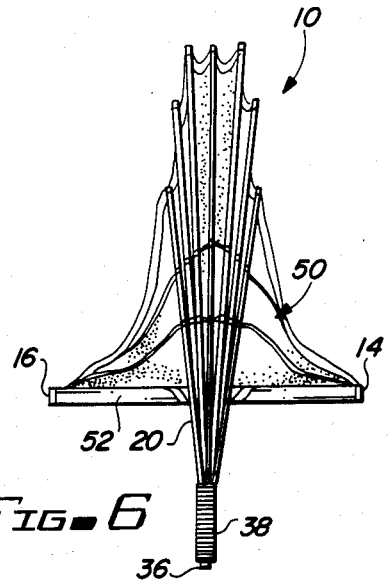
FIG. 6 is a front view illustrating the folding of the apparatus of the present invention.
Figure 7:
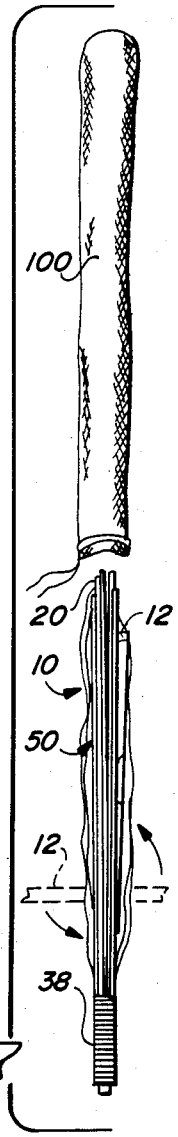
FIG. 7 is an exploded view illustrating the folding and storage of the apparatus of the present invention.

In FIGS. 1, 2, 3, and 4, the umbrella apparatus 10 is shown in its "open" configuration. To "close" the umbrella apparatus 10, and thus to fold the apparatus to a carrying position, the umbrella apparatus 10 is disassembled and folded by removing the lower end 36 of the support rod cluster 20 from the socket 18 in the base support element 12. This is shown in FIG. 5. FIGS. 6 and 7, which follow sequentially from FIG. 5, show the continuation of the folding process for the umbrella apparatus 10.

FIG. 6 is a front view showing the support rods or elements 22 . . . 34, in a cluster 20, with the flower end 36 removed from the base support element 12. With the tension removed from the support rods 22 . . . 34, the support rods or elements assume their normal, relatively straight configuration, and the material 50 hangs loosely from them.

For folding the material 50, and allowing the umbrella apparatus 10 to be stored, the base rod 12 is rotated approximately ninety degrees to align it with the general alignment of the support rods 22 . . . 34. This is shown in FIG. 7. The base support element 12 is shown in dotted line form in FIG. 7, and a pair of large arrows are disposed adjacent to the dotted line configuration of the base rod 12 to show the substantially ninety degree rotation to align it with the support rod cluster 20.

In FIG. 7, the umbrella apparatus 10 is shown disassembled and folded for storage. A bag 100 is shown in FIG. 7 disposed above the folded umbrella apparatus 10. The umbrella apparatus 10 may simply be inserted into the bag 100 for storage and transport purposes.

For assembly, the reverse procedure to that discussed above in the preceding paragraph is followed. The umbrella apparatus 10 is first removed from the bag 100. The base support element 12 is then pivoted substantially ninety degrees, in the reverse direction from that shown by the arrows in FIG. 7, to align it generally perpendicularly to the support rod cluster 20. This is best shown in FIG. 6.

After the apparatus is positioned as shown in FIG. 6, the sleeve 38 and the bottom end 36 of the rod cluster 20 is moved upwardly until the bottom end 36 of the rod cluster 20 can be inserted into the socket 18. With the end 36 inserted into the socket 18, the umbrella apparatus 10 assumes its generally concave/convex configuration, as illustrated in FIGS. 1 and 2. The umbrella apparatus 10 is then ready for use.

Figure 8:
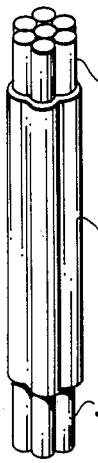
FIG. 8 is a perspective view of a portion of the apparatus of the present invention.

FIG. 8 is a perspective view of the bottom portion of the support rod cluster 20, illustrating the lower portion of the support rods or elements disposed within a sleeve 40 of shrink tubing or the like. Below the shrink tubing sleeve 40, the lower end 36 is exposed for appropriate insertion into a socket, such as the socket 18 (see FIG. 5).

Figure 9:
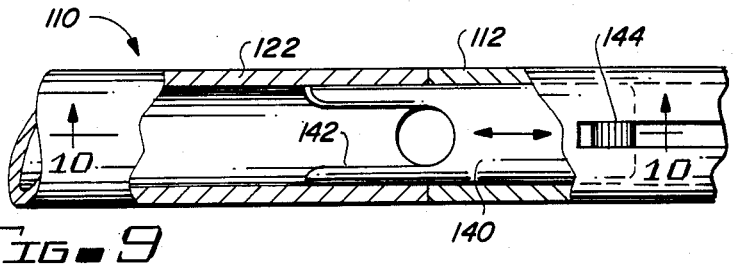
FIG. 9 is a top view in partial section of an alternate embodiment of a portion of the apparatus of the present invention.
Figure 10:
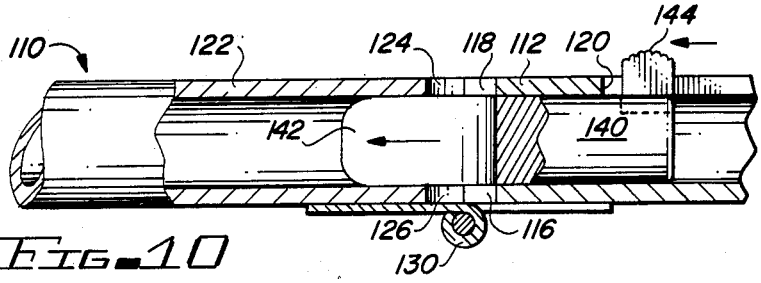
FIG. 10 is a view in partial section taken generally along line 10—10 of FIG. 9.
Figure 11:
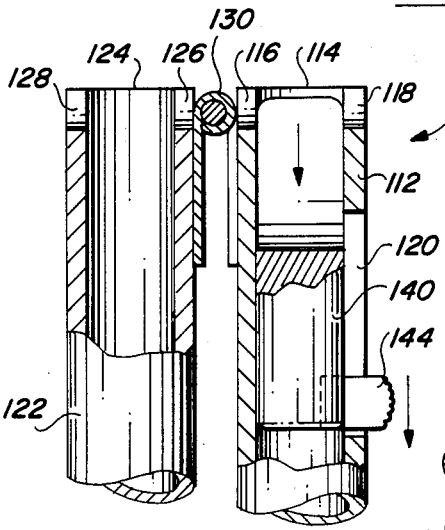
FIG. 11 is a view of the apparatus of FIG. 10 illustrating the folding of the apparatus shown in FIG. 10.

FIG. 9 is a top view, in partial section, of a portion of an alternate embodiment of a folding base element 110 usable with the umbrella apparatus of the present invention. FIG. 10 is a view in partial section of the folding base 110 of FIG. 9, taken generally along line 10—10 of FIG. 9. FIG. 10 is a side view, also in partial section, of a portion of the folding base 110. FIG. 11 is a side view in partial section of the folding base 110 of FIGS. 9 and 10, showing the base 110 actually folded. For the following discussion of the folding base 110, reference will primarily be made to FIGS. 9, 10, and 11.

The folding base 110 includes a pair of arms 112 and 122 which are secured together by a hinge 130. The arms 110 and 122 are preferably tubular elements hinged together so that when the arms 110 and 122 are axially aligned, they comprise a unitary base element into which the lower end 36 of the support rod cluster 20 may be disposed.

The arm 112 includes an end 114 and a pair of aligned slots 116 and 118. The slots 116 and 118 are diametrically aligned with each other and extend axially a relatively short distance from the end 112 and in alignment with the hinge 130. Spaced apart axially from the upper slot 118 is a locking slot 120.

The arm 122 includes an end 124 adjacent to the hinge 130. Extending axially inwardly from the end 124 are a pair of diametrically aligned slots 126 and 128. The slots 126 and 128 are aligned with the slots 118 and 116, respectively, of the arm 112. The four slots 116, 118 and 126, 128 define a socket into which the lower end 36 of the support rod cluster 20 extends for the umbrella apparatus 10.

Disposed within the tubular arms 112 and 122 is a slide lock 140. The slide lock 140 includes an axially extending slot 142 which is aligned with the socket slots 116, 118, 126, 128, to receive the rod cluster end 36. Extending upwardly from the slide lock 140 is a button 144. The button 144 is disposed within a radially extending slot in the slide lock 140 and extends outwardly therefrom. The button 144 extends through the slot 120 in the arm 112. Axial movement of the slide lock 140 by means of the button 144 moves the slide lock 140 into the arm 122 to lock the arms 112 and 122 together in an aligned orientation, as shown in FIGS. 9 and 10. When the slide lock 140 is withdrawn from the tubular arm 112, and wholly within the tubular arm 112, the arms 112 and 122 may be moved or folded relative to each other, as shown in FIG. 11.

Rather than including an axially extending slot 142 in the slide lock 140, the slot 142 may be replaced by a diametrically extending bore (not shown) through which the rod cluster end 36 may extend. Such a bore, when aligned with the slots 116, 118 and 126, 128 would comprise a continuous socket for receiving the end 136 of the rod cluster 20. This would insure that the slide lock 140 could not be axially moved while the rod cluster is inserted into the folding base 110. Rather, the rod cluster 20 would have to be removed from the folding base 110 in order to move the slide lock 140 out of the arm 122 to allow the folding base 110 to be folded.

Figure 12:
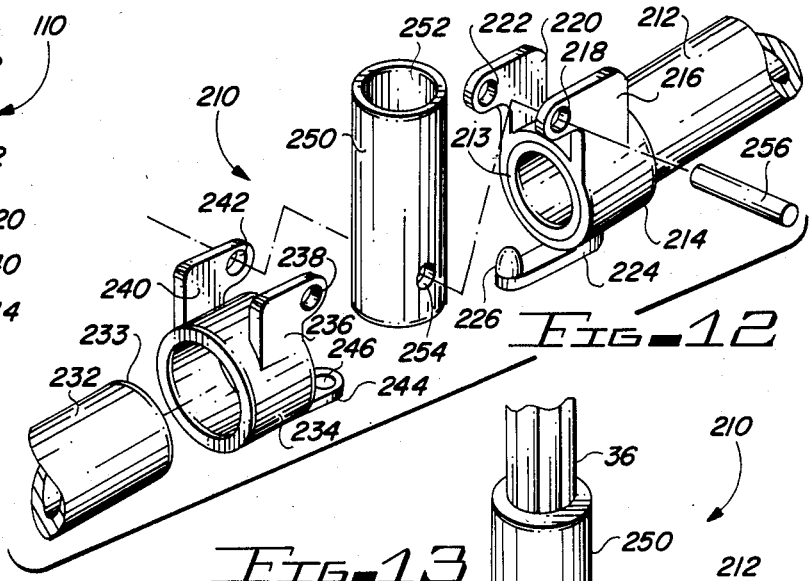
FIG. 12 is an exploded perspective view of an alternate embodiment of another portion of the apparatus of the present invention.

FIG. 12 is an exploded perspective view of a portion of an alternate embodiment of a folding base, namely a folding base element 210 usable with the umbrella apparatus of the present invention.

Figure 13:
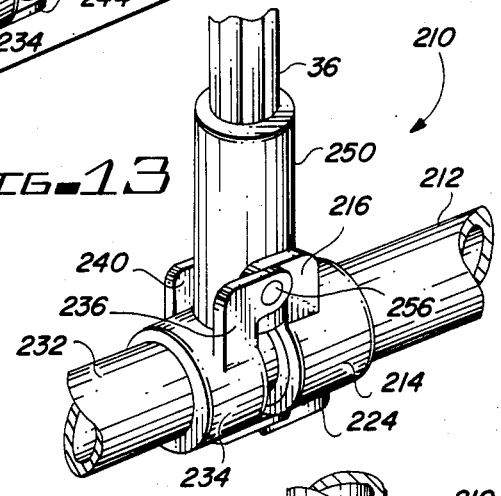
FIG. 13 is a perspective view of the apparatus of FIG. 12 in its assembled state.
Figure 14:
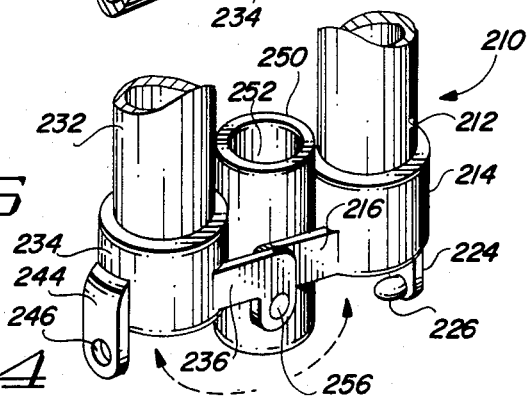
FIG. 14 is a perspective view of the apparatus of FIG. 13 illustrating the folding of the apparatus illustrated therein.

FIG. 13 is a perspective view of the folding base embodiment 210 in its assembled form, showing the lower or bottom end 36 of the supporting rod cluster 20 assembled to the base 210. FIG. 14 is a perspective view illustrating the folding of the base 210. For the following discussion of the folding base 210, reference will primarily be made to FIGS. 12, 13, and 14.

The folding base element 210 includes a pair of arms 212 and 232. The arms 212 and 232 are secured to a socket tube 250, and the arms 212 and 232 pivot or move relative to the socket tube 250.

A sleeve 214 is appropriately disposed about and secured to the arm 212 adjacent to an inner end 213 of the arm 212. The sleeve 214 includes a pair of spaced apart ears 216 and 220. The ears 216 and 220 are generally of an inverted "L" shape, with apertures extending through the ends of the ears remote from the sleeve 214. The ear 216 includes an aperture 218, and the ear 220 includes an aperture 222.

Extending axially along the bottom of the sleeve 214 is a tab 224. The tab 224 is secured to and extends outwardly beyond the sleeve remotely from the ears 216 and 220. Extending radially upwardly or inwardly with respect to the sleeve 214 from the tab 224 is a protrusion 226. The protrusion 226 extends radially inwardly and mates with an aperture in an aligned tab, as will be discussed below.

The arm 232 includes a sleeve 234 disposed about and secured to the arm 232 adjacent to an inner end 233 of the arm 232. The sleeve 234 includes a pair of generally parallel and aligned ears 236 and 240. The ears 236 and 240 are also of a generaly inverted "L" shape, and each arm includes an aperture at their respective distal ends, remote from the sleeve. The ear 236 includes an aperture 238, and the ear 240 includes an aperture 242. Extending axially along the bottom of the sleeve 234 is a tab 244. The tab 244 includes an aperture 246.

The socket tube 250 extends generally diametrically with respect to the arms 212 and 232 and their respective sleeves 214 and 234. The socket tube 250 includes a socket or bore 252 which receives the lower end 36 of the rod cluster 20. The end 36 of the rod cluster 20 is shown in FIG. 13 extending into the bore 252 of the socket tube 250.

At the lower end of the socket tube 250 is a pair of aligned pin apertures 254. One of the pin apertures 254 is shown in FIG. 12. The pin apertures 254 are diametrically extending.

When the socket tube 250 is assembled to the arms 212 and 232, the sleeve ears 216 and 220 are disposed on opposite sides of the socket tube 250, with the apertures 218 and 222 aligned with the pin apertures 254 of the socket tube 250. The ears 236 and 240 of the sleeve 234 are appropriately aligned with and disposed against the ears 216 and 220, respectively, of the sleeve 214. The apertures 238 and 242 are also aligned with the apertures 218 and 222 and 254 of the sleeve 214 and the socket tube 250, respectively. A pin 256 then extends through the aligned apertures to secure the arms 212 and 232 to the socket tube 250. This is shown in FIGS. 13 and 14.

To lock the three elements together, namely the arms 212 and 232 and the socket tube 250, the tabs 224 and 244 are secured together by the protrusion 226 of the tab 224 extending into the aperture 246 of the tab 244. This is shown in FIG. 13.

To allow the arms 212 and 232 to move relative to each other, and thus to fold the base 210, the protrusion 226 is withdrawn from the aperture 226. The arms 212 and 232 may then be pivoted on the pin 256 to allow the base 210 to fold. As shown in FIG. 14, the arms 212 and 232 may be folded into a parallel relationship with the socket tube 250. The folding base 210 may be opened for use by pivoting the arms 212 and 232 into alignment with each other, and by then inserting the protrusion 236 into the aperture 246 to lock the three elements together, as stated above.

Figure 15:
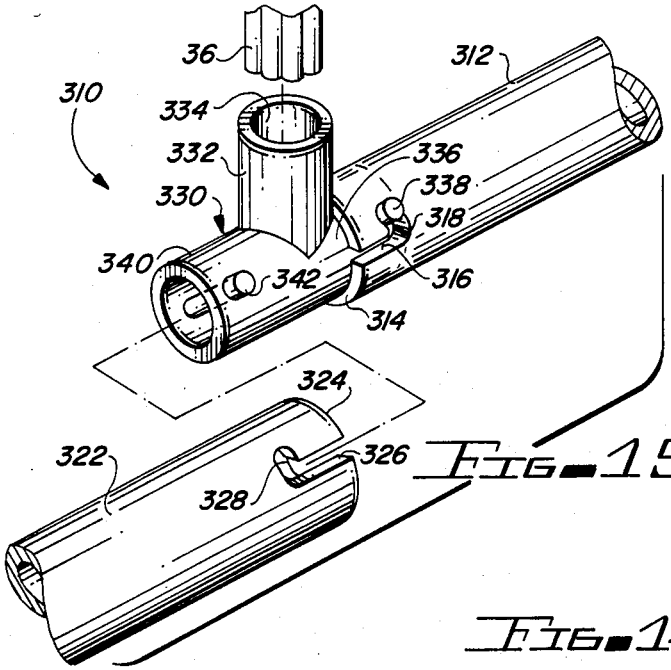
FIG. 15 is a perspective, partially exploded, view of another alternate embodiment of a portion of the apparatus of the present invention.

FIG. 15 is a perspective view, partially exploded, of another alternate embodiment of a base 310 usable with the umbrella apparatus 10 of the present invention. The base 310 includes a pair of arms 312 and 322 and an inverted tee shaped center element 330.

The arm 312 includes an inner end 314. The arm 312 is a tubular element which includes a pair of axially extending slots, of which a single axially extending slot 316 is shown in FIG. 15. The axial slots are parallel to each other and are substantially identical, and accordingly only the slot 316 will be discussed in detail.

The slot 316 is axially extending away from the end 314. At the distal end of the slot 316, remote from the end 314, is a locking slot 318. The slot 318 is circumferentially extending for a relatively short distance.

The arm 322 is substantially identical to the arm 312. It is also a tubular element with an inner end 324. A pair of axially extending slots extend along the arm 322 from the end 324. Only an axially extending slot 326 is shown in FIG. 15. The slot 236 is substantially identical to the slot 316. At the distal end of the slot 326, remote from the end 324, is a locking slot 328. The locking slot 328 extends circumferentially for a relatively short distance.

The tee 330 includes a socket tube 332. The socket tube 322 comprises the "leg" of the "tee" with the cross arm comprising a pair of relatively short arms 336 and 340.

The socket tube 332 includes a bore 334 which receives the end 36 of the rod support cluster 20. The end 36 is shown spaced slightly apart from the bore 334.

The cross arms 336 and 340 each include a diametrically extending pin, both of which extend outwardly a relatively short distance from the arms 336 and 340. The arm 336 includes a pin 338, and the arm 340 includes a pin 342. The outer diameter of the arms 336 and 340 is slightly less than the inner diameter of the arms 312 and 322, respectively, and the arms 336 and 340 accordingly extend into the arms 312 and 322. the pins 338 and 342 are respectively aligned with the pairs of axially extending slots in the arms 312 and 322. With the pins extending into the axially extending slots, the arms 312 and 322 are appropriately rotated so that the pins 338 and 342 are disposed within the locking slots. The pin 338 is shown disposed within the locking slot 318, and the pin 342 would extend into the locking slot 328 if the arm 322 were assembled to the arm 340 of the tee 330.

With the arms 312 and 322 secured to the tee 330, the base element 310 is ready to receive the support rod cluster 36 and the associated elements of the umbella apparatus 10. The folding or diassembly of the base 310 is accomplished by merely rotating the arms 312 to move the pins out of the locking slots, and the arms may then be removed from the tee by outward axial movements. The elements of the umbrella apparatus may then be conveniently stowed for storage, transporting, etc. As is clearly shown in FIGS. 1–5 and 13–15, the support rod cluster is disposed substantially perpendicularly to the base element. This provides the symmetry shown in FIGS. 1 and 2.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Flexed fan umbrella apparatus comprising, in combination:

base means, including a base support element having a first end and a second end, a support element means, including a plurality of support elements secured to the base support element of the base means between its first end and its second end, and which support elements are substantially perpendicular to the base support element and then diverge and curve away from each other; and covering means secured to and extending from the base support element and extending outwardly therefrom and secured to the plurality of support elements to contact said support elements along their length where said covering means stresses said support elements into arcuate shapes to provide a generally concave-convex umbrella extending outwardly from the base support element.

2. The apparatus of claim 1 in which the base means includes socket means for receiving the plurality of support elements.

3. The apparatus of claim 2 in which the plurality of support elements comprises a cluster of support elements secured together adjacent to the base means for extending into the socket means, and each support element of the plurality of support elements extends outwardly from each other remote from the base element.

4. The apparatus of claim 3 in which the socket means includes a socket for receiving the plurality of support elements.

5. The apparatus of claim 3 in which the covering means includes a base tube portion secured to the base means.

6. The apparatus of claim 3 in which the base means further includes a first portion and a second portion movable relative to the first portion.

7. The apparatus of claim 6 in which the base means further includes means for locking the first portion and second portion of the base means together in general alignment with each other.

8. The apparatus of claim 7 in which the first portion and second portion pivot relative to each other to comprise a folding base element.

9. The apparatus of claim 6 in which the base means further includes a third portion, and the socket means is disposed in the third portion.

10. The apparatus of claim 9 in which the first portion and the second portion are movable relative to the third portion.

11. The apparatus of claim 10 in which the first portion and the second portion pivot relative to the third portion.

12. The apparatus of claim 10 in which the first portion and the second portion are removable from the third portion.

13. The apparatus of claim 1 in which the support element means includes means for securing the plurality of support elements together adjacent to the base means to define a cluster of support elements.

14. The apparatus of claim 13 in which the support element means further includes a lower end of the cluster extending into the socket means.

* * * * *